US010276953B2

(12) United States Patent
Huang et al.

(10) Patent No.: US 10,276,953 B2
(45) Date of Patent: Apr. 30, 2019

(54) ELECTRICAL CONNECTOR

(71) Applicant: LOTES CO., LTD, Keelung (TW)

(72) Inventors: Chang Wei Huang, Keelung (TW); Zhi Youg Zhou, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/869,332

(22) Filed: Jan. 12, 2018

(65) Prior Publication Data

US 2018/0331441 A1 Nov. 15, 2018

Related U.S. Application Data

(60) Provisional application No. 62/505,206, filed on May 12, 2017.

(30) Foreign Application Priority Data

Aug. 10, 2017 (CN) ..... 2017 1 0678778

(51) Int. Cl.
*H01R 13/40* (2006.01)
*H01R 12/57* (2011.01)
(Continued)

(52) U.S. Cl.
CPC ..... *H01R 12/57* (2013.01); *H01R 12/714* (2013.01); *H01R 12/716* (2013.01); *H01R 13/26* (2013.01);
(Continued)

(58) Field of Classification Search
CPC .... H01R 13/26; H01R 13/40; H01R 13/6461; H01R 12/57; H01R 12/714; H01R 12/52; H01R 12/716; H01R 33/18; H01R 43/02
(Continued)

(56) References Cited

U.S. PATENT DOCUMENTS 5,312,261 A * 5/1994 Burke ..... H01R 13/24 439/52
5,920,252 A * 7/1999 Nakagawa ..... H01C 10/32 338/160
(Continued)

FOREIGN PATENT DOCUMENTS

CN 2840357 Y 11/2006
CN 1972018 A 5/2007
(Continued)

*Primary Examiner* — Abdullah A Riyami
*Assistant Examiner* — Vladimir Imas
(74) *Attorney, Agent, or Firm* — Locke Lord LLP; Tim Tingkang Xia, Esq.

(57) ABSTRACT

An electrical connector for electrically connecting with a chip module, which includes: an insulating body; and multiple terminals, respectively and correspondingly accommodated in the insulating body. Each terminal has: a base portion having a vertical plane; a first arm, bending and extending upward from the base portion toward a direction away from the vertical plane; a second arm, bending and extending reversely from the first arm and crossing the vertical plane, configured to abut the chip module; and a through-slot, running through the second arm vertically, where the through-slot at least extends to a bending location between the second arm and the first arm, so that the second arm forms two branches at two opposite sides of the through-slot, and the second arm has a beam connecting the two branches, so as to reduce self-inductance of the terminal, and improve a high-frequency signal transmission capability of the electrical connector.

20 Claims, 22 Drawing Sheets

(51) Int. Cl.

| | |
|---|---|
| ***H01R 13/26*** | (2006.01) |
| ***H01R 12/71*** | (2011.01) |
| ***H01R 43/02*** | (2006.01) |
| ***H01R 13/6461*** | (2011.01) |
| *H01R 13/24* | (2006.01) |
| *H01R 33/18* | (2006.01) |
| *H01R 12/52* | (2011.01) |
| *H01R 13/41* | (2006.01) |

(52) U.S. Cl.
CPC ..... *H01R 13/40* (2013.01); *H01R 13/6461* (2013.01); *H01R 43/02* (2013.01); *H01R 12/52* (2013.01); *H01R 13/2442* (2013.01); *H01R 13/2492* (2013.01); *H01R 13/41* (2013.01); *H01R 33/18* (2013.01)

(58) Field of Classification Search
USPC ..... 439/595
See application file for complete search history.

(56) References Cited

U.S. PATENT DOCUMENTS 6,113,440 A * 9/2000 Fijten ..... H01R 13/2492 439/862
6,227,870 B1 * 5/2001 Tanaka ..... H01R 13/2435 361/749
6,293,833 B1 * 9/2001 Kamath ..... H01R 13/113 439/839
6,315,621 B1 * 11/2001 Natori ..... H01R 13/2428 439/862
6,454,607 B2 * 9/2002 Bricaud ..... G06K 7/0021 439/180
6,471,534 B1 * 10/2002 Lee ..... H01R 13/193 439/342
6,695,628 B2 * 2/2004 Yeh ..... H01R 13/2442 439/500
6,824,414 B2 * 11/2004 Whyne ..... H01R 13/193 439/342
6,984,130 B2 * 1/2006 Richter ..... H01R 13/2435 439/66
7,014,477 B2 * 3/2006 Tsai ..... H01R 13/2442 439/331
7,070,465 B2 * 7/2006 Masaki ..... H01R 13/113 439/850
7,112,102 B2 * 9/2006 Masaki ..... H01R 13/113 439/660
7,207,821 B1 * 4/2007 Ju ..... H01R 4/4809 439/331
7,278,892 B1 * 10/2007 Chien ..... H01R 13/2442 439/862
7,297,010 B2 * 11/2007 Tsai ..... H01R 13/2442 439/331
7,341,485 B2 * 3/2008 Polnyi ..... H01R 13/2435 439/591
7,377,789 B1 * 5/2008 Liu ..... H01R 13/2442 439/66
7,387,541 B1 * 6/2008 Lai ..... H01R 13/2442 439/660
7,390,229 B2 * 6/2008 Huang ..... H01R 11/282 439/862
7,445,518 B2 * 11/2008 Schneider nee Hild ..... H01R 13/2428 439/700
7,503,770 B2 * 3/2009 Fan ..... H01R 13/2435 439/66
7,559,811 B1 * 7/2009 Polnyi ..... H01R 4/4809 439/591
7,575,469 B1 * 8/2009 Hung ..... H01R 13/2442 439/500
7,588,441 B2 * 9/2009 Chang ..... H01R 13/2492 439/66
7,654,862 B2 * 2/2010 Liao ..... H01R 13/2435 439/526
7,867,043 B2 * 1/2011 Yuan ..... H01R 12/89 439/857
7,914,314 B2 * 3/2011 Szu ..... H01R 4/02 439/260
8,147,256 B2 * 4/2012 Jin ..... H01R 12/52 439/83
8,221,172 B2 * 7/2012 Ju ..... H01R 13/111 439/342
8,235,734 B2 * 8/2012 Ju ..... H01R 12/57 439/83
8,267,725 B2 * 9/2012 Zhu ..... H01R 13/41 439/660
8,298,021 B2 * 10/2012 Huang ..... H01R 13/2492 439/500
8,414,311 B2 * 4/2013 Ju ..... H01R 12/89 439/83
8,556,667 B2 * 10/2013 Koyama ..... H01R 13/41 439/474
8,903,459 B2 * 12/2014 Choi ..... H04M 1/0237 455/572
9,033,750 B2 * 5/2015 Miller ..... H01R 13/26 439/862
9,437,948 B2 * 9/2016 Ju ..... H01R 12/7076
9,590,345 B2 * 3/2017 Wollitzer ..... H01R 13/2421
9,843,119 B1 * 12/2017 Chen ..... H01R 13/112
9,887,480 B2 * 2/2018 Tanaka ..... H01R 13/2442
9,941,614 B2 * 4/2018 Sato ..... H01R 12/716
9,985,368 B2 * 5/2018 Deng ..... H01R 12/714
2004/0132319 A1 * 7/2004 Richter ..... H01R 13/2435 439/66

FOREIGN PATENT DOCUMENTS

| | | | |
|---|---|---|---|
| CN | 201097405 | Y | 8/2008 |
| CN | 201097410 | Y | 8/2008 |
| CN | 201122684 | Y | 9/2008 |
| CN | 201549675 | U | 8/2010 |
| CN | 201708302 | U | 1/2011 |
| CN | 202067919 | U | 12/2011 |

* cited by examiner

2

2

2

2

2

2

ELECTRICAL CONNECTOR

CROSS-REFERENCE TO RELATED PATENT APPLICATION

This application claims priority to and the benefit of, pursuant to 35 U.S.C. § 119(e), U.S. provisional patent application Ser. No. 62/505,206 filed May 12, 2017. This application also claims priority to and benefit of, under 35 U.S.C. § 119(a), Patent Application No. 201710678778.1 filed in P.R. China on Aug. 10, 2017. The entire contents of the above-identified applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular, to an electrical connector in which a high-frequency signal may be transmitted and a terminal has multiple conductive paths.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Chinese Patent Application No. CN200920311973.1 discloses an electrical connector, including an insulating body and conductive terminals accommodated in the insulating body. The conductive terminal includes a base portion, retaining portions extending upward from two sides of the base portion, and an elastic arm bending upward and extending from the base portion. An end of the elastic arm is provided with a contact portion abutting a chip module.

However, currently, a chip module has an increasingly large quantity of conductive pads, and the conductive pads are arranged increasingly densely. Therefore, the terminals in the electrical connector are also arranged increasingly densely. Consequently, a self-inductance effect is easily generated in the terminals during signal transmission, and particularly high-frequency signal transmission, and then crosstalk is generated between neighboring terminals due to a self-inductance effect of the terminals. As a result, the electrical connector has a poor high-frequency signal transmission capability, and actual requirements cannot be satisfied.

Therefore, a heretofore unaddressed need to design improved electrical connector exists in the art to address the aforementioned deficiencies and inadequacies.

SUMMARY

In view of the problem addressed in the background technology, an objective of the present invention is to provide an electrical connector, which has a preferable high-frequency signal transmission capability by a slot which is formed on a contact portion and an elastic arm of a terminal to reduce self-inductance and crosstalk.

To achieve the foregoing objective, the present invention adopts the following technical solutions. An electrical connector for electrically connecting with a chip module includes: an insulating body; and a plurality of terminals, respectively and correspondingly accommodated in the insulating body, each of the terminals having: a base portion having a vertical plane; a first arm, bending and extending upward from the base portion toward a direction away from the vertical plane; a second arm, bending and extending reversely from the first arm and crossing the vertical plane, wherein the second arm is configured to abut the chip module; and a through-slot, running through the second arm vertically, wherein the through-slot at least extends to a bending location between the second arm and the first arm, so that the second arm forms two branches at two opposite sides of the through-slot, and the second arm has a beam connecting the two branches.

In certain embodiments, the terminals are formed by punching a metal plate, and a width of the through-slot is greater than a thickness of each of the terminals and less than a width of each of the branches.

In certain embodiments, the beam is disposed at an end of the second arm.

In certain embodiments, the second arm comprises an extending arm connected to the first arm and a contact portion bending and extending upward from the extending arm and configured to abut the chip module, the through-slot extends to the contact portion, and a width of the through-slot in the contact portion is less than a width of the through-slot in the extending arm.

In certain embodiments, the width of the through-slot in the contact portion is a constant width.

In certain embodiments, the second arm is provided with two protruding portions protruding upward symmetrically located at the two opposite sides of the through-slot, and the two protruding portions simultaneously abut a same pad of the chip module.

In certain embodiments, the beam abuts the chip module.

In certain embodiments, the beam is provided with a protruding portion protruding upward and configured to abut the chip module.

In certain embodiments, the through-slot extends to a connecting location between the first arm and the base portion.

In certain embodiments, the through-slot extends downward only to the bending location between the second arm and the first arm.

In certain embodiments, a width of the through-slot in the second arm is a constant width.

In certain embodiments, the second arm comprises an extending arm and a contact portion bending and extending from the extending arm, the beam is disposed at a connecting location between the extending arm and the contact portion, and the through-slot runs through a free end of the contact portion, so that the contact portion forms two free ends.

In certain embodiments, the second arm has a contact portion configured to abut the chip module, and an upper surface of the contact portion slants downward to form a chamfering surface, so that a contact area between the contact portion and the chip module is reduced.

In certain embodiments, the base portion bends and extends downward to form a bending portion, the bending portion bends and extends to form a conducting portion configured to be conductively connected to a circuit board, and a through-hole runs through the base portion and the bending portion and does not run through the conducting portion.

Compared with the related art, the embodiments of the present invention have the following beneficial effects.

The through-slot runs through the second arm vertically, and the through-slot at least extends to a bending location between the second arm and the first arm, so as to reduce the self-inductance effect of the terminals during signal transmission, avoid crosstalk between adjacent terminals, and improve the high-frequency signal transmission capability of the terminals.

In another technical solution, an electrical connector for electrically connecting with a chip module includes: an insulating body; and a plurality of terminals, respectively and correspondingly accommodated in the insulating body, each of the terminals having: a base portion; an elastic arm, bending and extending upward from one end of the base portion, and configured to abut the chip module; a through-slot, running through the elastic arm, wherein in an extending direction of the elastic arm, a length of the through-slot is greater than sixty percent of a length of the elastic arm, the elastic arm forms two branches at two opposite sides of the through-slot, and the elastic arm has a beam connecting the two branches; a bending portion, formed by bending and extending downward from an opposite end of the base portion; a through-hole, extending from the base portion to the bending portion; and a conducting portion, formed by bending and extending from the bending portion, and configured to be conductively connected to the circuit board, wherein the through-hole does not run through the conducting portion.

In certain embodiments, the through-slot extends downward to a connecting location between the elastic arm and the base portion.

In certain embodiments, the elastic arm has a contact portion configured to abut the chip module, and the through-slot runs through the contact portion to a free end of the contact portion, so that the contact portion forms two free ends and two contact areas simultaneously abutting a same pad of the chip module.

In certain embodiments, the conducting portion comprises a connecting portion bending downward and extending from the bending portion, and two clamping portions bending and extending from two opposite sides of the connecting portion and jointly clamping a solder, the bending portion and the connecting portion are located at a same side of the base portion, and along a downward direction, a width of the bending portion is gradually reduced.

In certain embodiments, the through-hole comprises a first through-hole disposed in the base portion, the first through-hole has a top edge and a side edge extending obliquely downward from the top edge, and the top edge and the side edge form an obtuse angle.

In certain embodiments, the through-hole comprises a second through-hole disposed in the bending portion, and along a downward direction, a width of the second through-hole is gradually reduced.

Compared with the related art, the embodiments of the present invention have the following beneficial effects.

In an extending direction of the elastic arm, the length of the through-slot is greater than sixty percent of the length of the elastic arm, so as to reduce the self-inductance effect of the terminals during signal transmission, and avoid crosstalk between neighboring terminals. Moreover, the through-hole runs through the base portion and the bending portion and does not run through the conducting portion, so that each of the terminals form four conductive paths, including two conductive paths that are parallel to each other from top to bottom and are from two opposite sides of the through-slot and the through-hole, and two crossed conductive paths that are from the left side of the through-slot to the right side of the through-hole and from the right side of the through-slot to the left side of the through-hole. By means of these four conductive paths, the high-frequency signal transmission capability of the terminals may be improved.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
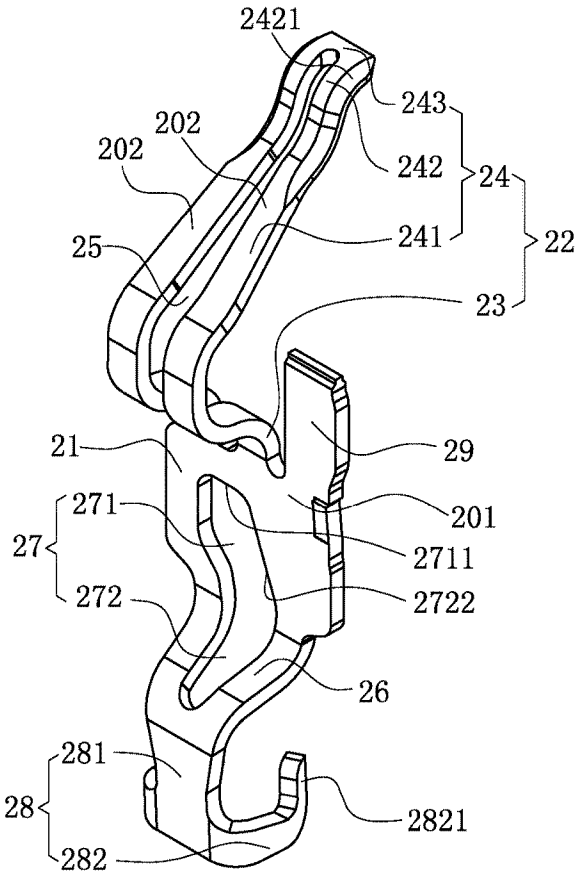
FIG. 1 is a perspective view of a terminal of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-22. In accordance with the purposes of this invention, as embodied and broadly described herein, this invention, in one aspect, relates to an electrical connector.

Figure 2:
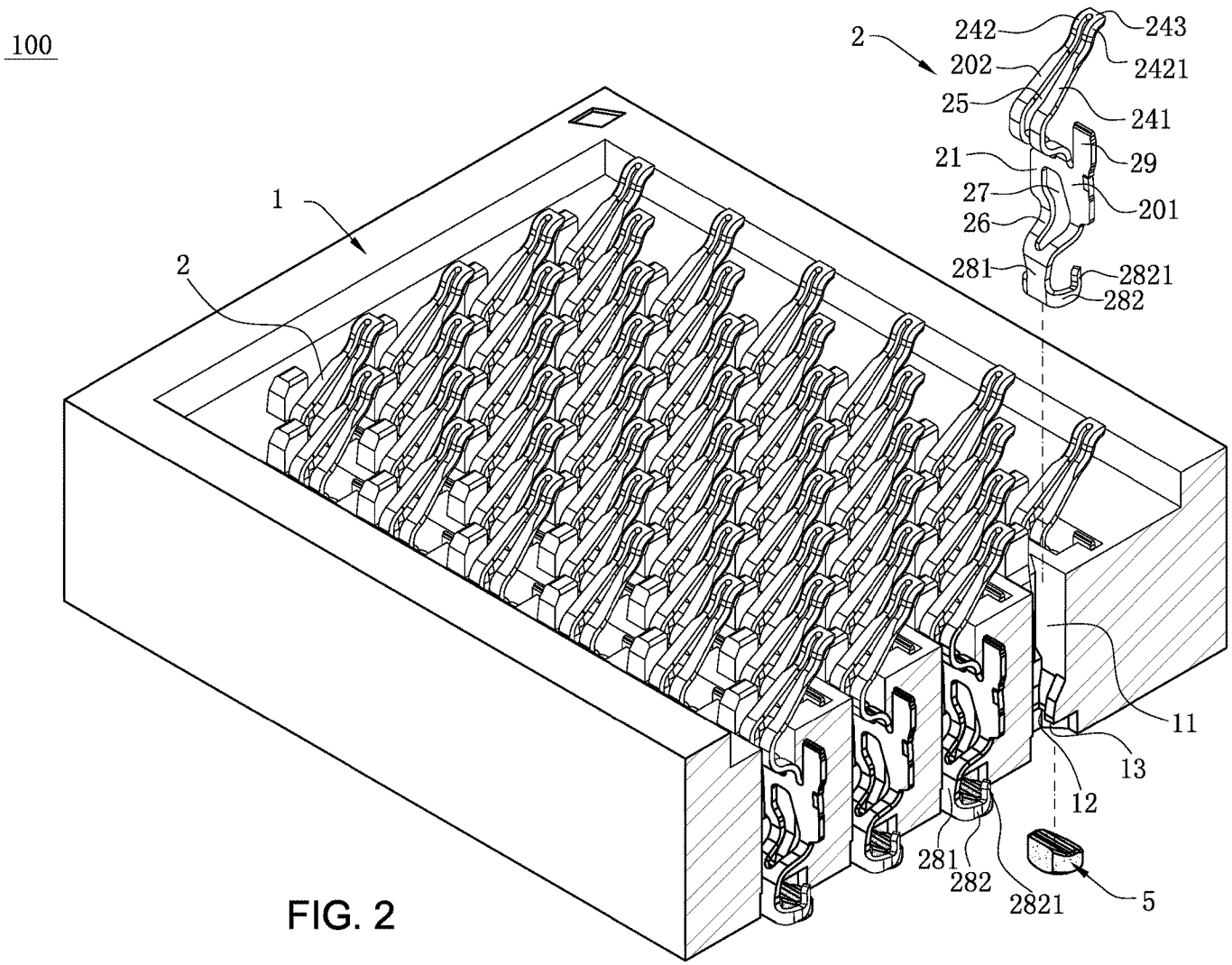
FIG. 2 is a schematic local perspective sectional view of the electrical connector according to the first embodiment of the present invention.
Figure 5:
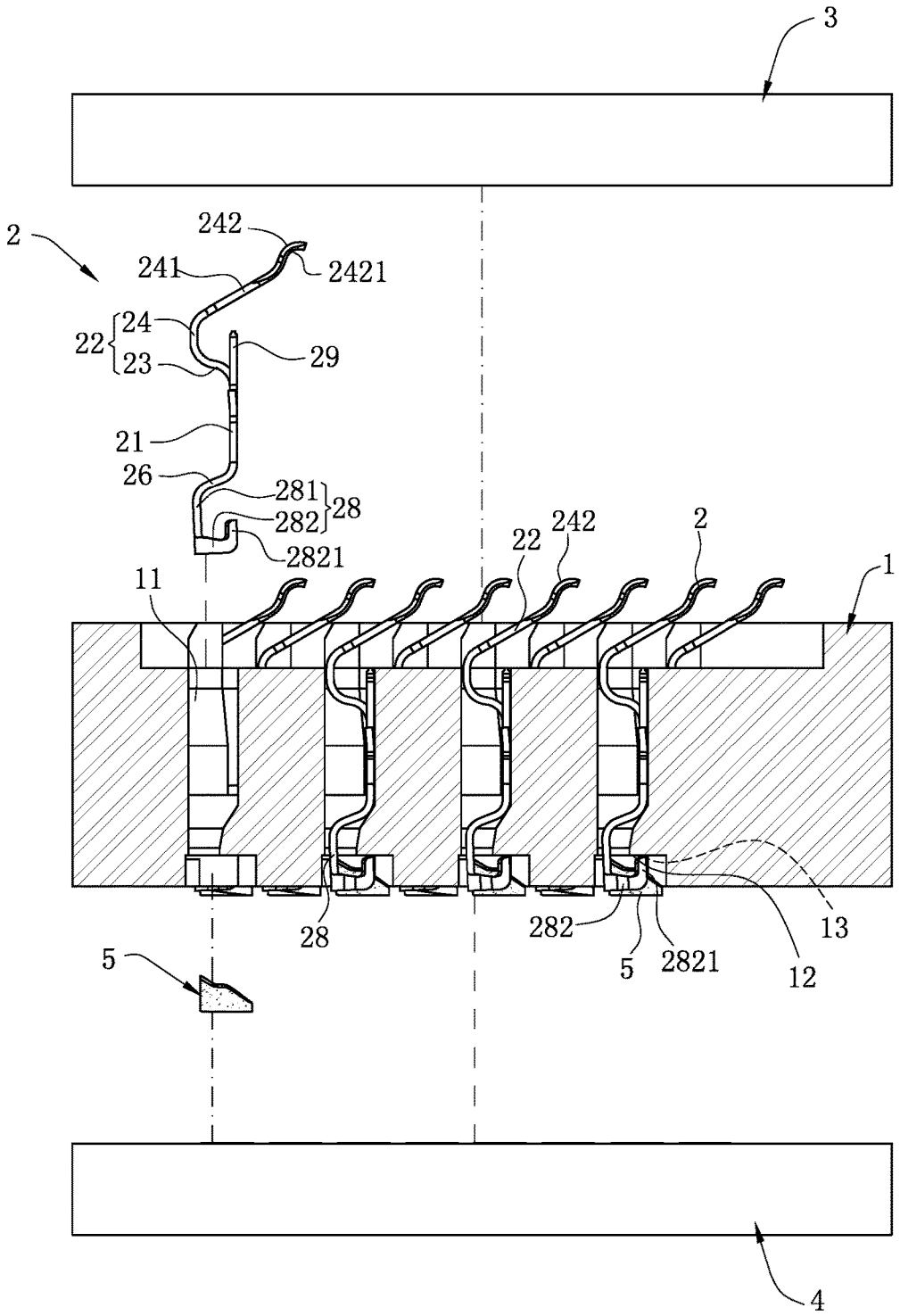
FIG. 5 is a schematic sectional view from another viewing angle of the electrical connector according to the first embodiment of the present invention, before the electrical connector is soldered to a circuit board and before a chip module is installed.
Figure 6:
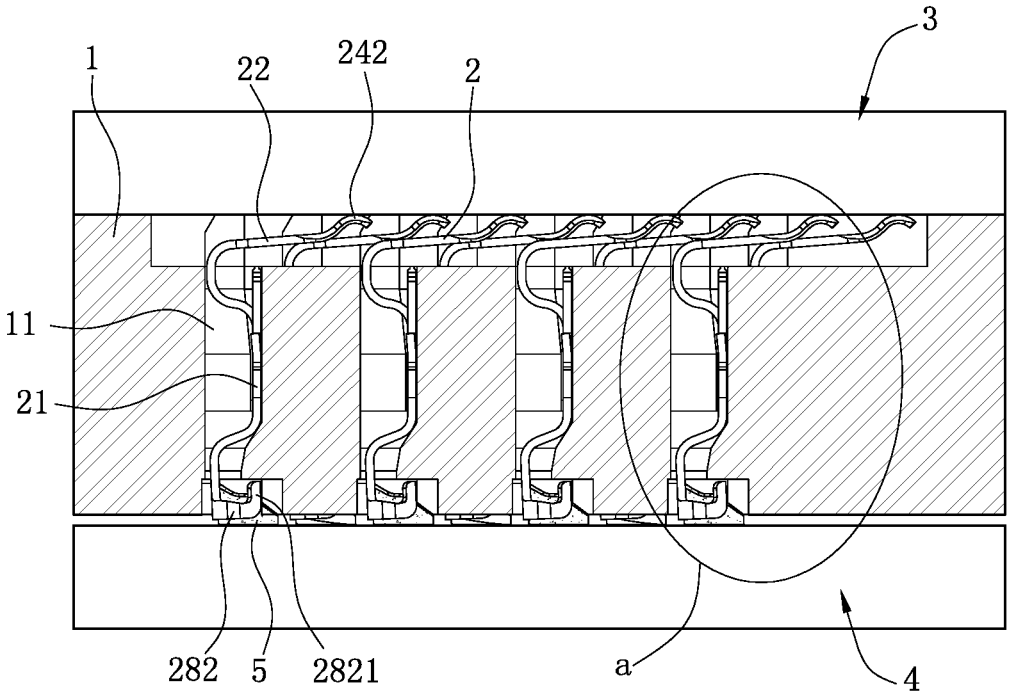
FIG. 6 is a two-dimensional sectional view the electrical connector according to the first embodiment of the present invention, after the electrical connector is soldered to the circuit board and after a chip module is installed.

FIG. 2, FIG. 5 and FIG. 6 show an electrical connector 100 according to a first embodiment of the present invention. The electrical connector 100 of the embodiment of the present invention is used to electrically connect a chip module 3 to a circuit board 4, and includes an insulating body 1 and multiple terminals 2 retained in the insulating body 1. One end of each of the terminals 2 elastically abuts the chip module 3, and another end is soldered to the circuit board 4 by a solder 5.

Figure 3:
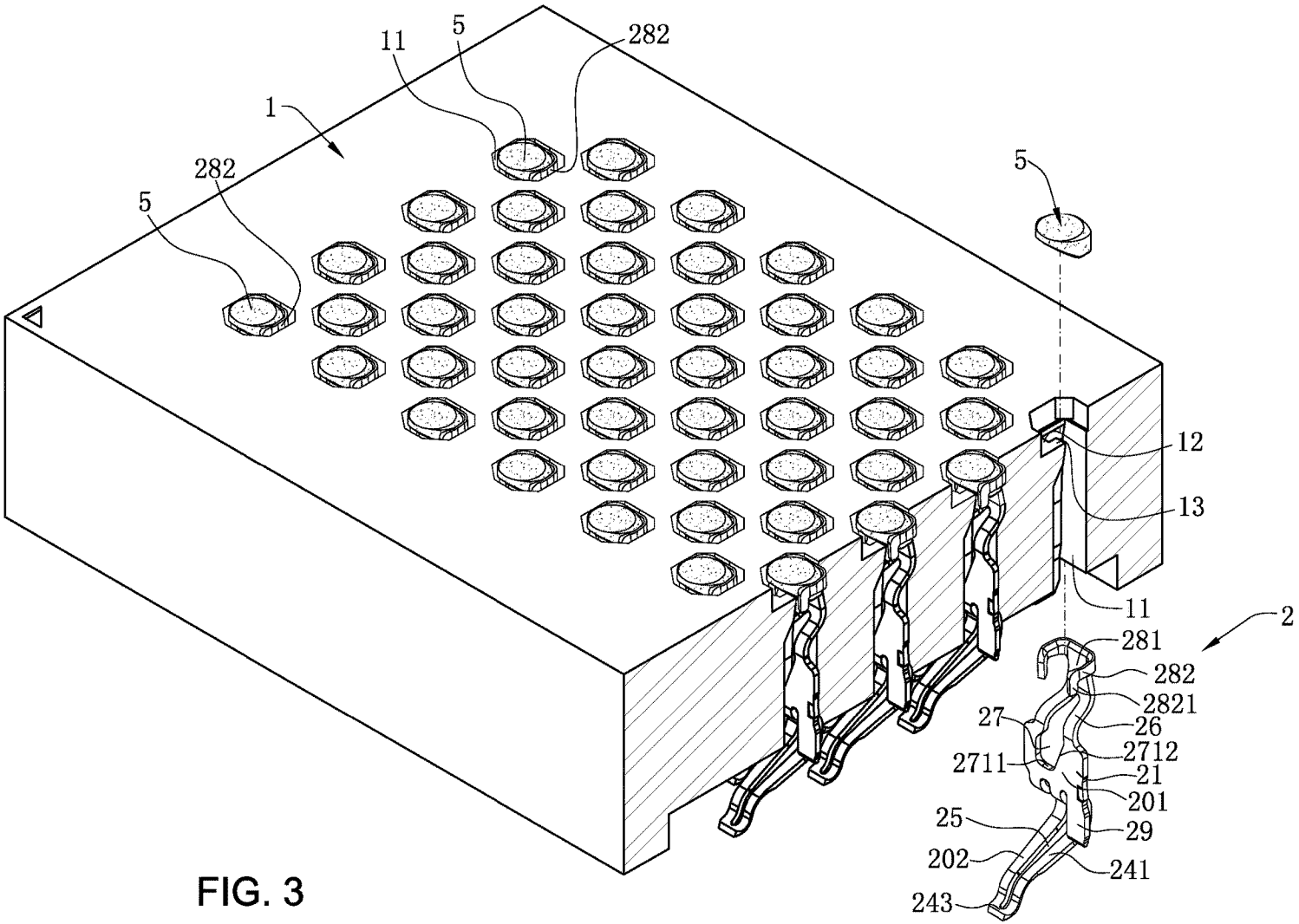
FIG. 3 is a schematic view of FIG. 2 being inversed 180°.

As shown in FIG. 2 and FIG. 3, the insulating body 1 is provided with multiple accommodating holes 11 that are arranged in a matrix, run through the insulating body 1 vertically, and correspondingly accommodate the terminals 2. Each of the accommodating holes 11 is provided with a first stopping surface 12 and a second stopping surface 13. The first stopping surface 12 stops the terminal 2, and the second stopping surface 13 stops the solder 5, so as to limit upward movement of the terminal 2 and the solder 5 by stopping functions of the first stopping surface 12 and the second stopping surface 13. In this embodiment, the first stopping surface 12 and the second stopping surface 13 have a same height. That is, the two are located on a same horizontal plane. In other embodiments, the first stopping surface 12 and the second stopping surface 13 may have different heights.

Figure 4:
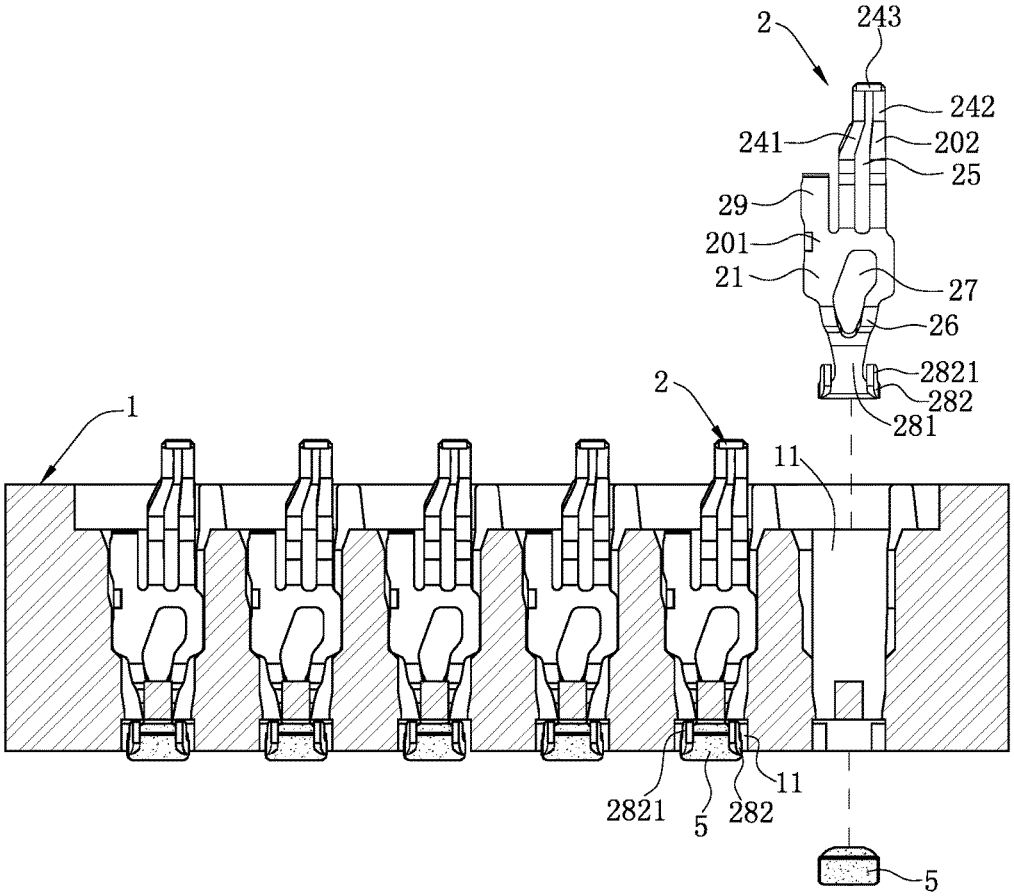
FIG. 4 is a schematic sectional view of the electrical connector according to the first embodiment of the present invention.

As shown in FIG. 1, FIG. 4 and FIG. 5, the terminals 2 are formed by punching a metal plate, and each has a base portion 21. The base portion 21 has a vertical plane 201. A strip connecting portion 29 extends vertically upward and an elastic arm 22 bends and extends upward from an upper end of the base portion 21. The strip connecting portion 29 is used to connect to a strip (not shown), and the elastic arm 22 elastically abuts the chip module 3. Further, the elastic arm 22 includes a first arm 23 bending and extending upward from the base portion 21 toward a direction away from the vertical plane 201, and a second arm 24 reversely bending and extending from the first arm 23 and crossing the vertical plane 201. Such setting increases the elasticity of the elastic arm 22, so as to ensure good electrical contact between the terminal 2 and the chip module 3. The second arm 24 includes an extending arm 241 connected to the first arm 23, and a contact portion 242 bending and extending upward from the extending arm 241. The contact portion 242 abuts a pad of the chip module 3 upward. An upper surface of the contact portion 242 slants downward to form a chamfering surface 2421, so that a contact area between the contact portion 242 and the pad of the chip module 3 is reduced, so as to reduce a risk of the contact portion 242 slipping off from the pad of the chip module 3. A through-slot 25 runs through the elastic arm 22 vertically, and the through-slot 25 extends upward to the contact portion 242, and extends downward to a connecting location between the first arm 23 and the base portion 21. In this way, a length of the through-slot 25 in the elastic arm 22 is increased to a maximum extent, so as to reduce the self-inductance of the elastic arm 22 and crosstalk between neighboring terminals 2, and also increase the elasticity of the elastic arm 22. In other embodiments, the through-slot 25 may not extend to the connecting location between the first arm 23 and the base portion 21. As long as a length of the through-slot 25 is greater than sixty percent of the length of the elastic arm 22 along an extending direction of the elastic arm 22, the self-inductance effect of the terminal 2 may be significantly reduced.

Preferably, in an extending direction of the elastic arm 22, a width of the through-slot 25 is first kept constant, then gradually reduced, and then kept constant again, so that the width of the through-slot 25 in the contact portion 242 is a constant width, and the width of the through-slot 25 in the contact portion 242 is less than the width of the through-slot 25 in the extending arm 241, so as to facilitate the elastic structure requirement of all of the terminals 2.

As shown in FIG. 1 and FIG. 4, the second arm 24 forms two branches 202 at two opposite sides of the through-slot 25 respectively, and on each of the branches 202, the contact portion 242 is formed with a contact area urging the chip module 3. Thus, each of the terminals 2 has two contact areas abutting the chip module 3, so as to increase contact points between the terminal 2 and the chip module 3, and improve the high-frequency signal transmission capability of the terminal 2. An end of the second arm 24 has a beam 243, and the beam 243 connects the two branches 202, so as to prevent the two branches 202 from excessively moving toward a direction away from each other and causing undesired contact between the contact portion 242 and the chip module 3. Further, the width of the through-slot 25 is greater than the thickness of the terminal 2 and less than the width of each branch 202, thereby avoiding the width of the through-slot 25 to be excessively large to cause relatively poor strength of the terminal 2, and avoiding the width of the through-slot 25 to be excessively small to cause excessively small impact on the self-inductance effect of the terminal 2. Therefore, a balance between the structure strength of the terminal 2 and the function requirement of the terminal 2 is achieved.

Figure 7:
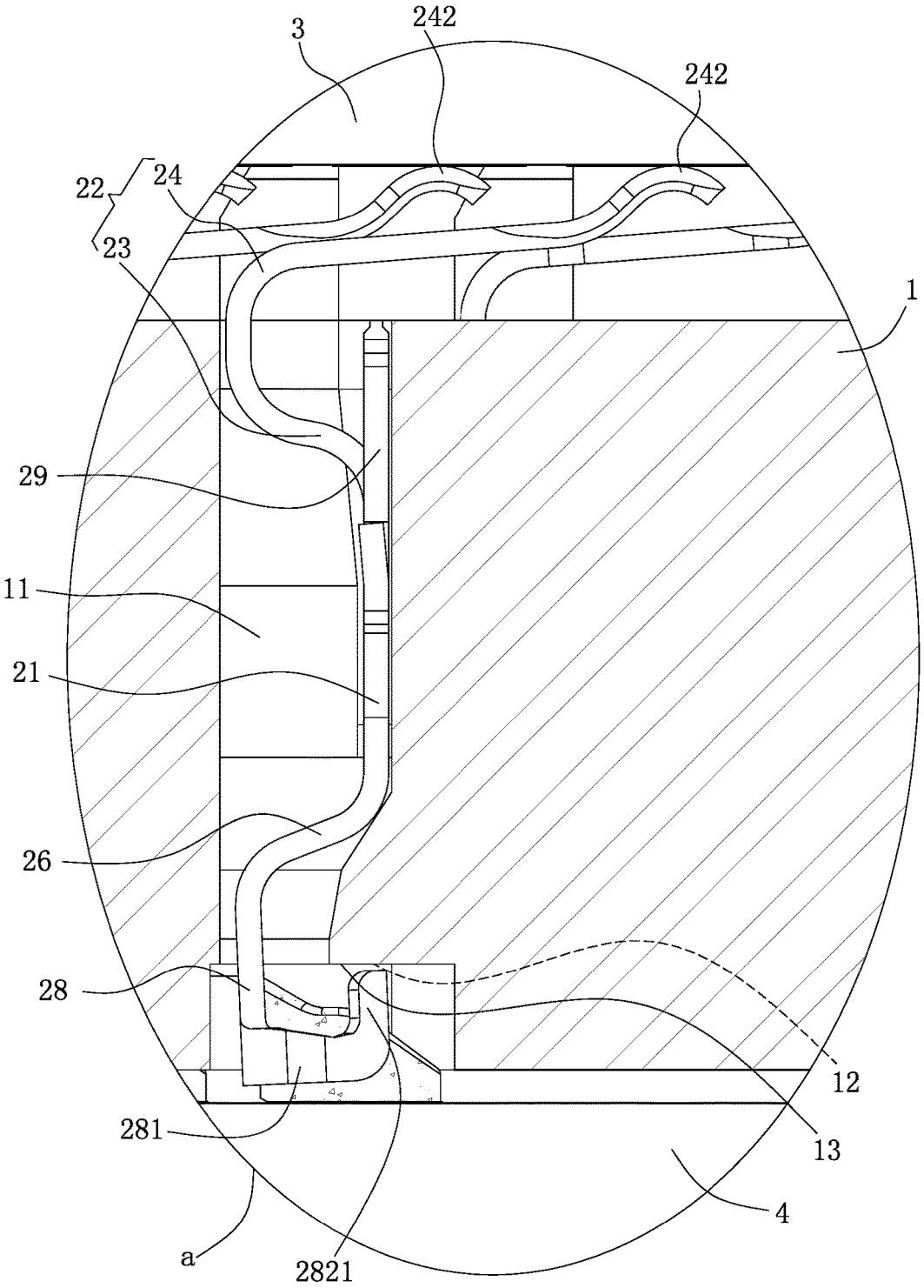
FIG. 7 is an enlarged view of a part a in FIG. 6.

As shown in FIG. 1, FIG. 6 and FIG. 7, a bending portion 26 is formed by bending and extending downward from the base portion 21, and the bending portion 26 and the first arm 23 are located at a same side of the vertical plane 201. A conducting portion 28 is formed by bending and extending from the bending portion 26, and is used to conduct the circuit board 4. Specifically, the conducting portion 28 includes a connecting portion 281 bending downward and extending from the bending portion 26, and two clamping portions 282 bending and extending from two opposite sides of the connecting portion 281 and jointly clamping the solder 5, and the conducting portion 28 is soldered to the circuit board 4 by the solder 5. The bending portion 26 and the connecting portion 281 are located at a same side of the base portion 21, and along a downward direction, a width of the bending portion 26 is gradually reduced, so as to increase the elasticity of the bending portion 26. Additionally, a stopping portion 2821 projects upward from the clamping portion 282, and stops below the first stopping surface 12, so as to prevent the clamping portion 282 from excessively moving upward when the solder 5 is loaded, and ensure that the clamping portion 282 stably clamps the solder 5 so that the terminal 2 and the circuit board 4 are stably soldered.

A through-hole 27 runs through the base portion 21 and extends from the base portion 21 to the bending portion 26 but does not extend to the conducting portion 28. That is, the through-slot 25 runs through the base portion 21 and the bending portion 26 and does not run through the conducting portion 28. In this way, the self-inductance effect of the terminal 2 may be further reduced, and it is ensured that the conducting portion 28 has sufficient strength. Further, the through-hole 27 includes a first through-hole 271 disposed in the base portion 21 and a second through-hole 272 disposed in the bending portion 26. The first through-hole 271 has a top edge 2711 and a side edge 2712 extending obliquely downward from the top edge 2711. The top edge 2711 and the side edge 2712 form an obtuse angle, and along a downward direction, the width of the second through-hole 272 is gradually reduced.

As shown in FIG. 4, FIG. 6 and FIG. 7, after the electrical connector 100 is soldered to the circuit board 4, the chip module 3 is loaded into the electrical connector 100, and the terminals 2 stably abut the chip module 3, each of the terminals 2 may form four conductive paths, including two conductive paths that are parallel to each other from top to bottom and are from two opposite sides of the through-slot 25 and the through-hole 27, and two crossed conductive path that are from the left side of the through-slot 25 to the right side of the through-hole 27 and from the right side of the through-slot 25 to the left side of the through-hole 27. By means of these four conductive paths, the high-frequency signal transmission capability of the terminal 2 may be improved.

Figure 8:
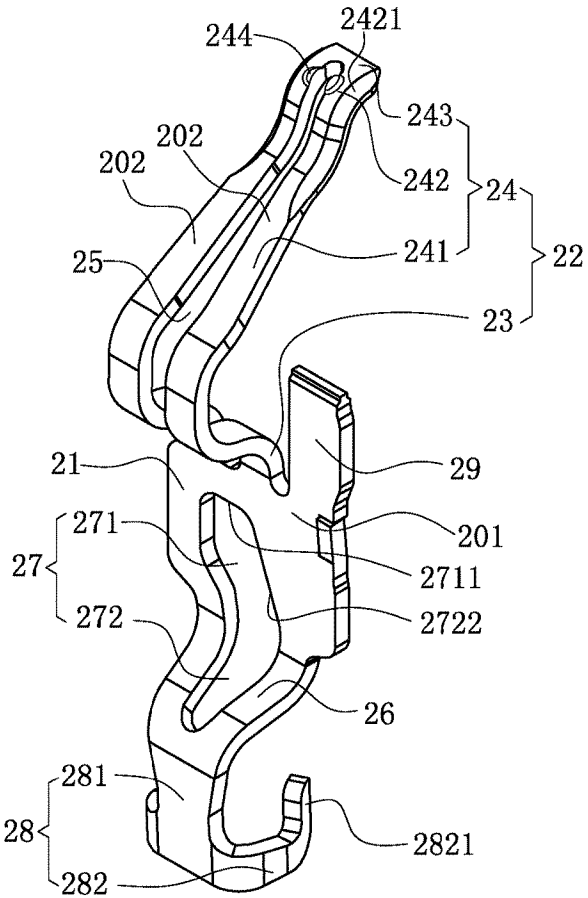
FIG. 8 is a perspective view of a terminal of the electrical connector according to a second embodiment of the present invention.
Figure 9:
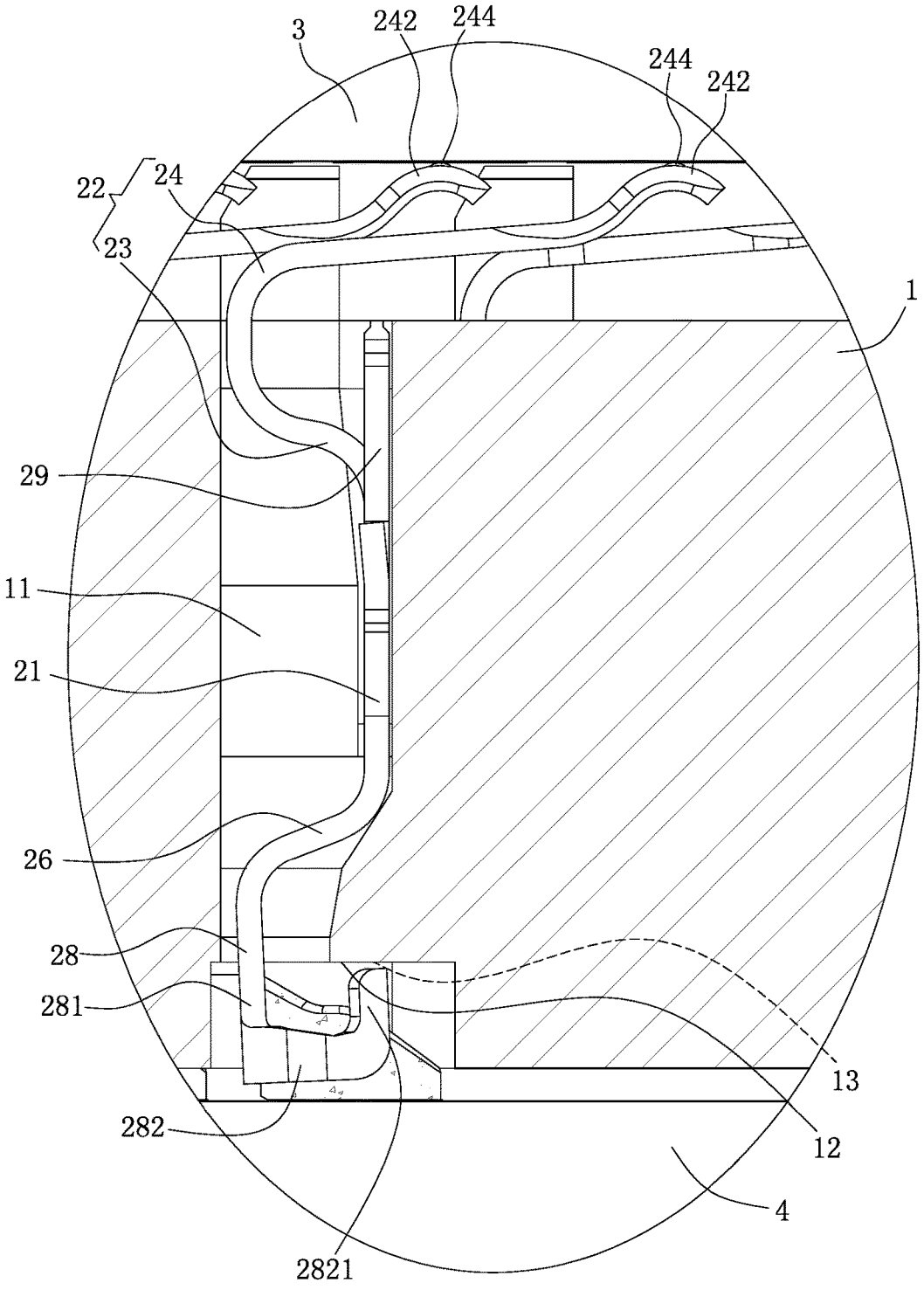
FIG. 9 is a schematic local plain sectional view of the electrical connector according to the second embodiment of the present invention after a chip module is press-fit to a terminal.
Figure 10:
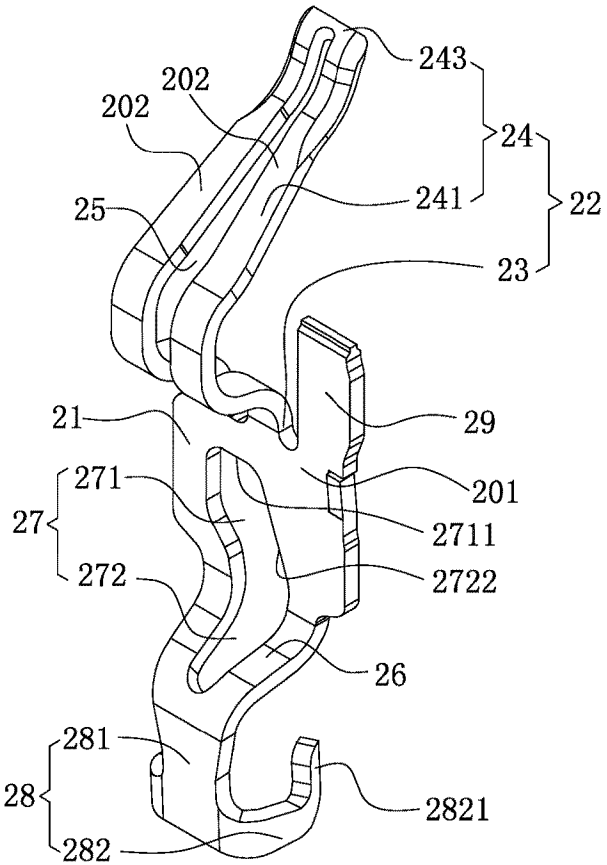
FIG. 10 is a perspective view of a terminal of an electrical connector according to a third embodiment of the present invention.
Figure 11:
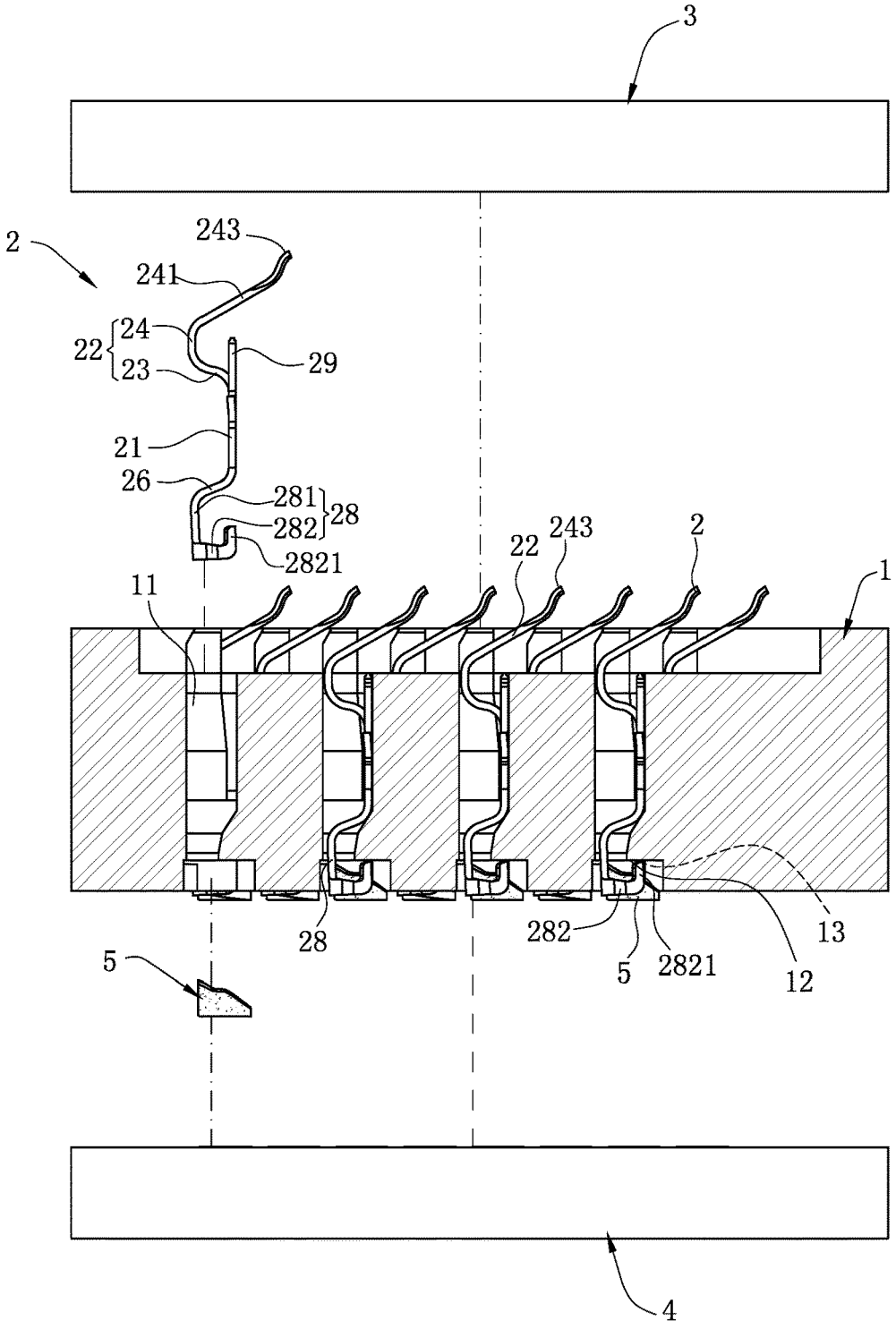
FIG. 11 is a schematic sectional view of the electrical connector according to the third embodiment of the present invention, before the electrical connector is soldered to a circuit board and before a chip module is installed.
Figure 12:
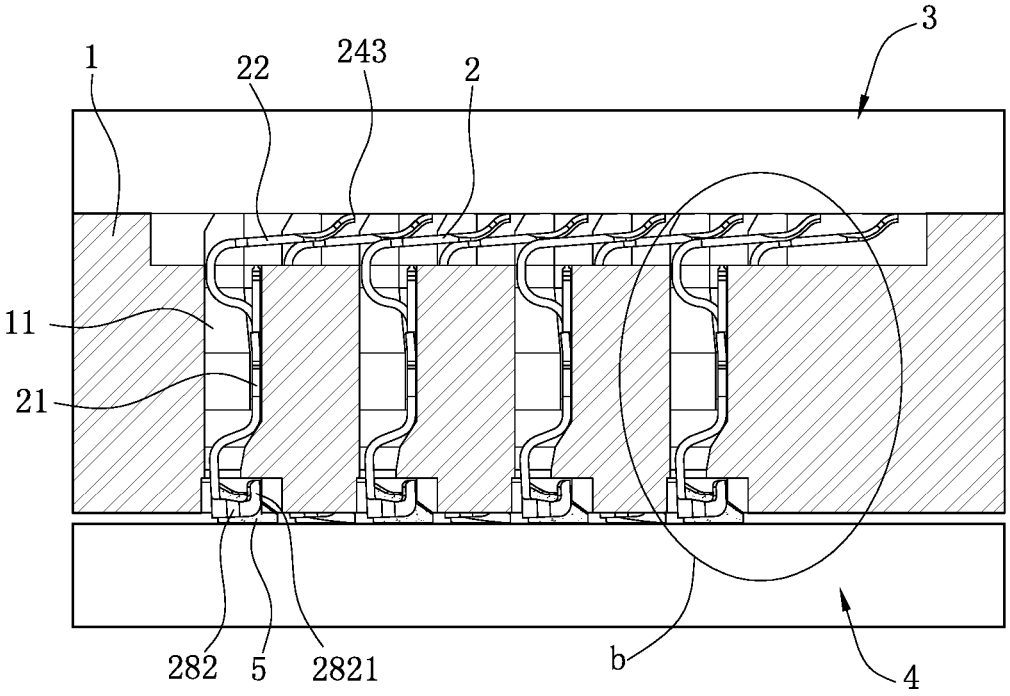
FIG. 12 is a schematic sectional view of the electrical connector according to the third embodiment of the present invention, after the electrical connector is soldered to a circuit board and after a chip module is installed.
Figure 13:
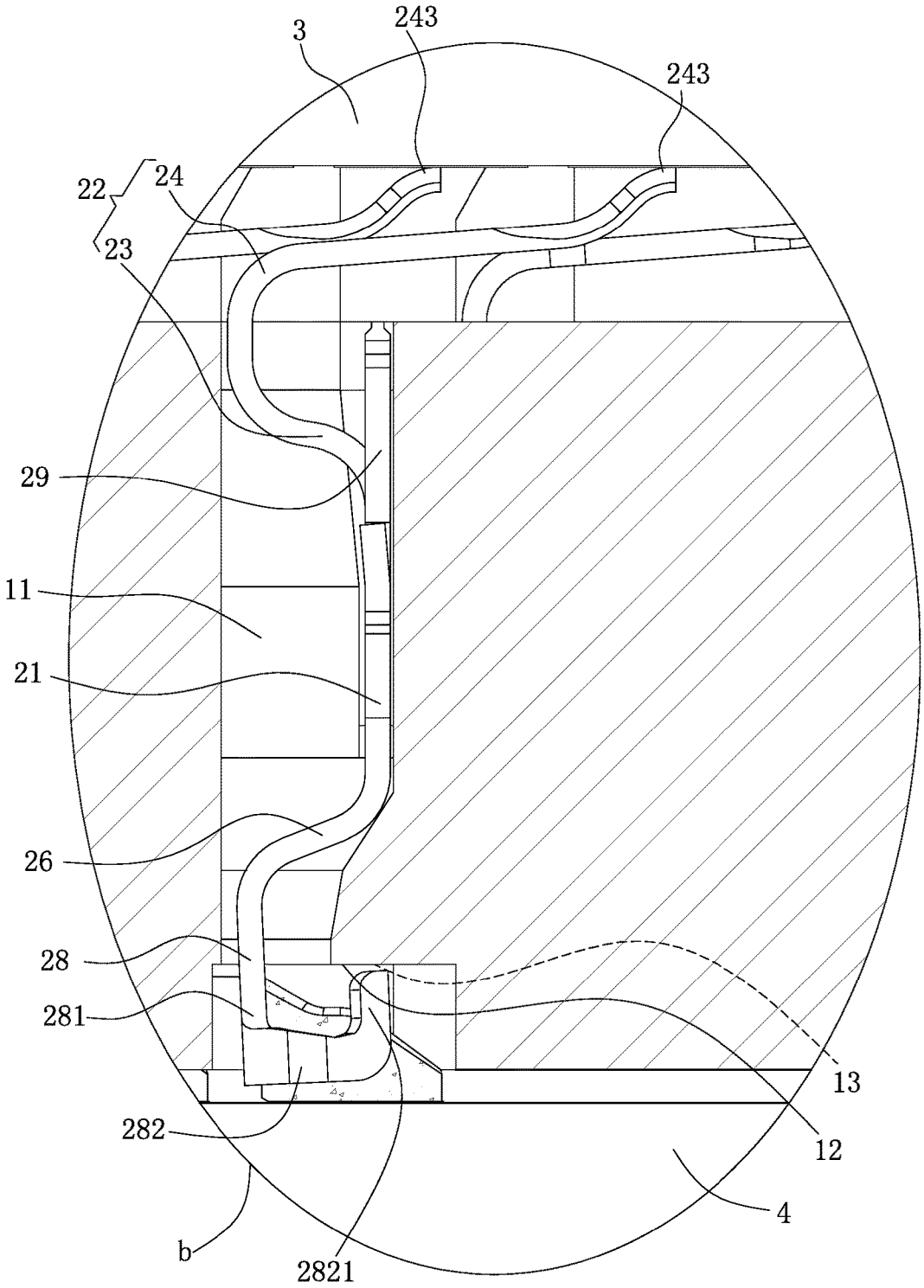
FIG. 13 is an enlarged view of a part b in FIG. 12.

FIG. 8 and FIG. 9 show an electrical connector 100 according to a second embodiment of the present invention. This embodiment mainly differs from the first embodiment in that, in this embodiment, two symmetrical protruding portions 244 protrude upward from the contact portion 242 and are respectively located at two branches 202, and the two protruding portions 244 simultaneously abut a same pad of the chip module 3. In this way, the contact area between the terminal 2 and the pad of the chip module 3 may be reduced. The remaining structures and functions thereof are completely the same as those of the first embodiment, and details are not elaborated herein.

FIG. 10 to FIG. 13 show an electrical connector 100 according to a third embodiment of the present invention. The third embodiment mainly differs from the first embodiment in that: the beam 243 directly abuts the chip module 3. The remaining structures and functions thereof are completely the same as those of the first embodiment, and details are not elaborated herein.

Figure 14:
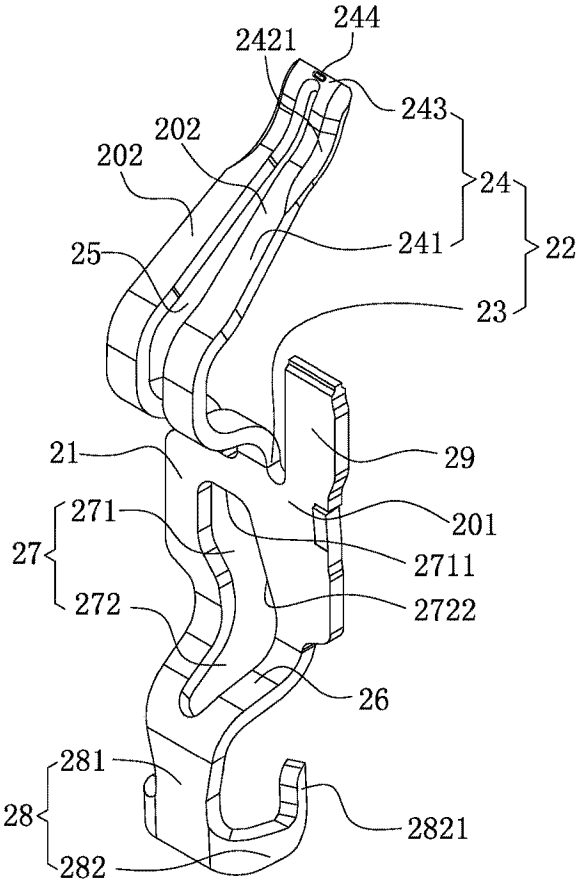
FIG. 14 is a perspective view of a terminal of an electrical connector according to a fourth embodiment of the present invention.
Figure 15:
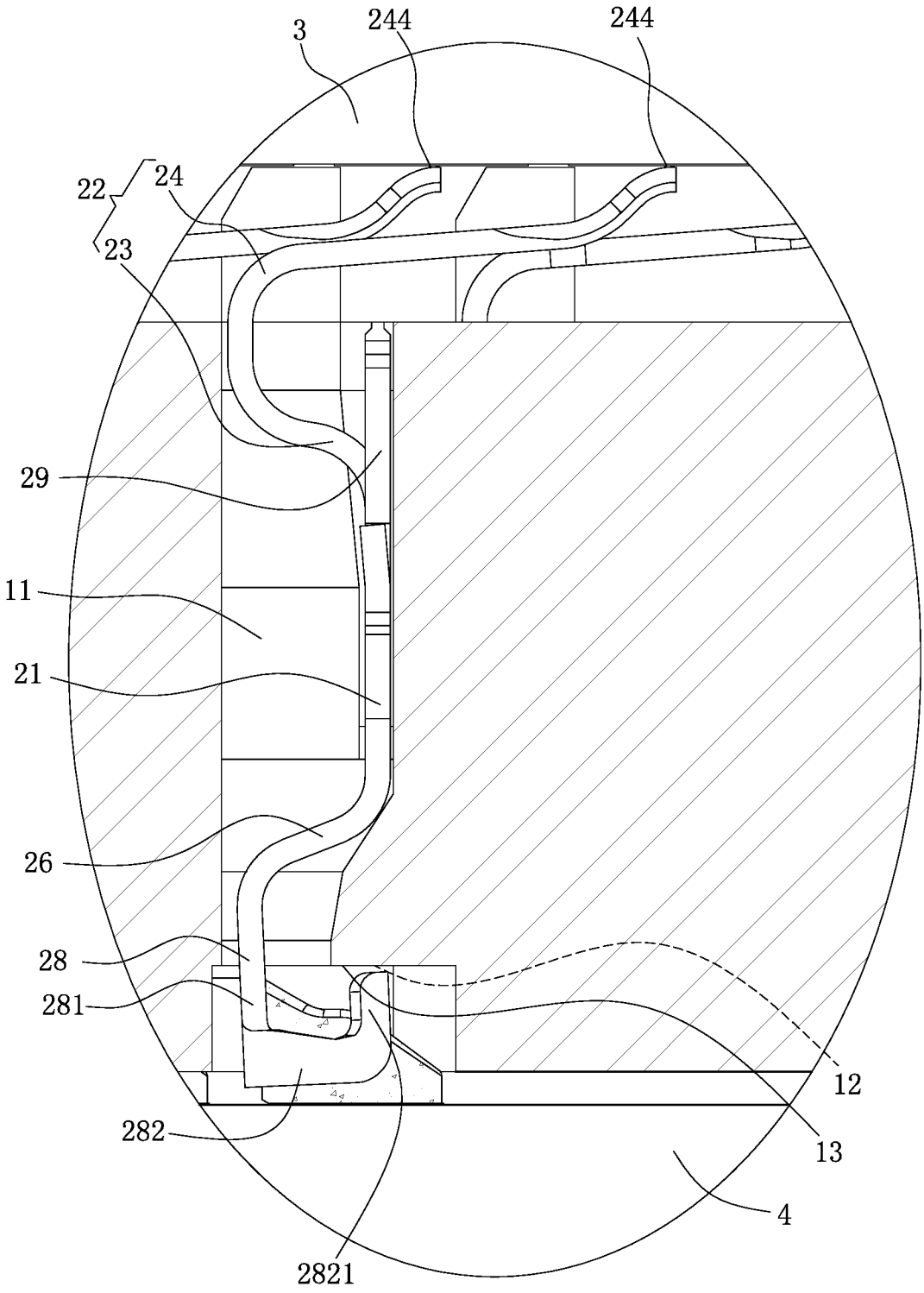
FIG. 15 is a schematic local plain sectional view of the electrical connector according to the fourth embodiment of the present invention after a chip module is press-fit to a terminal.
Figure 16:
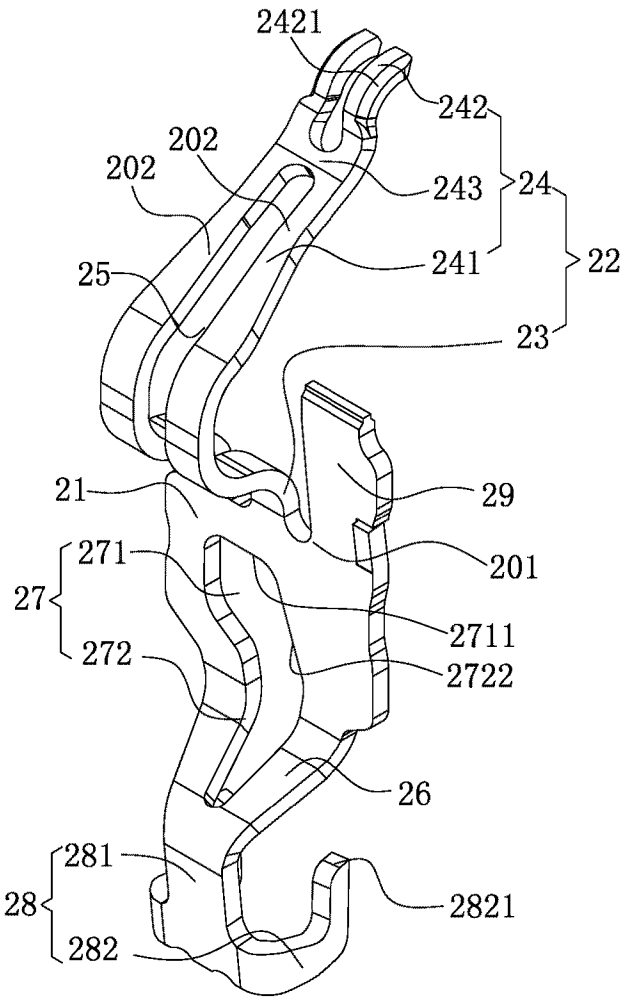
FIG. 16 is a perspective view of a terminal of an electrical connector according to a fifth embodiment of the present invention.
Figure 17:
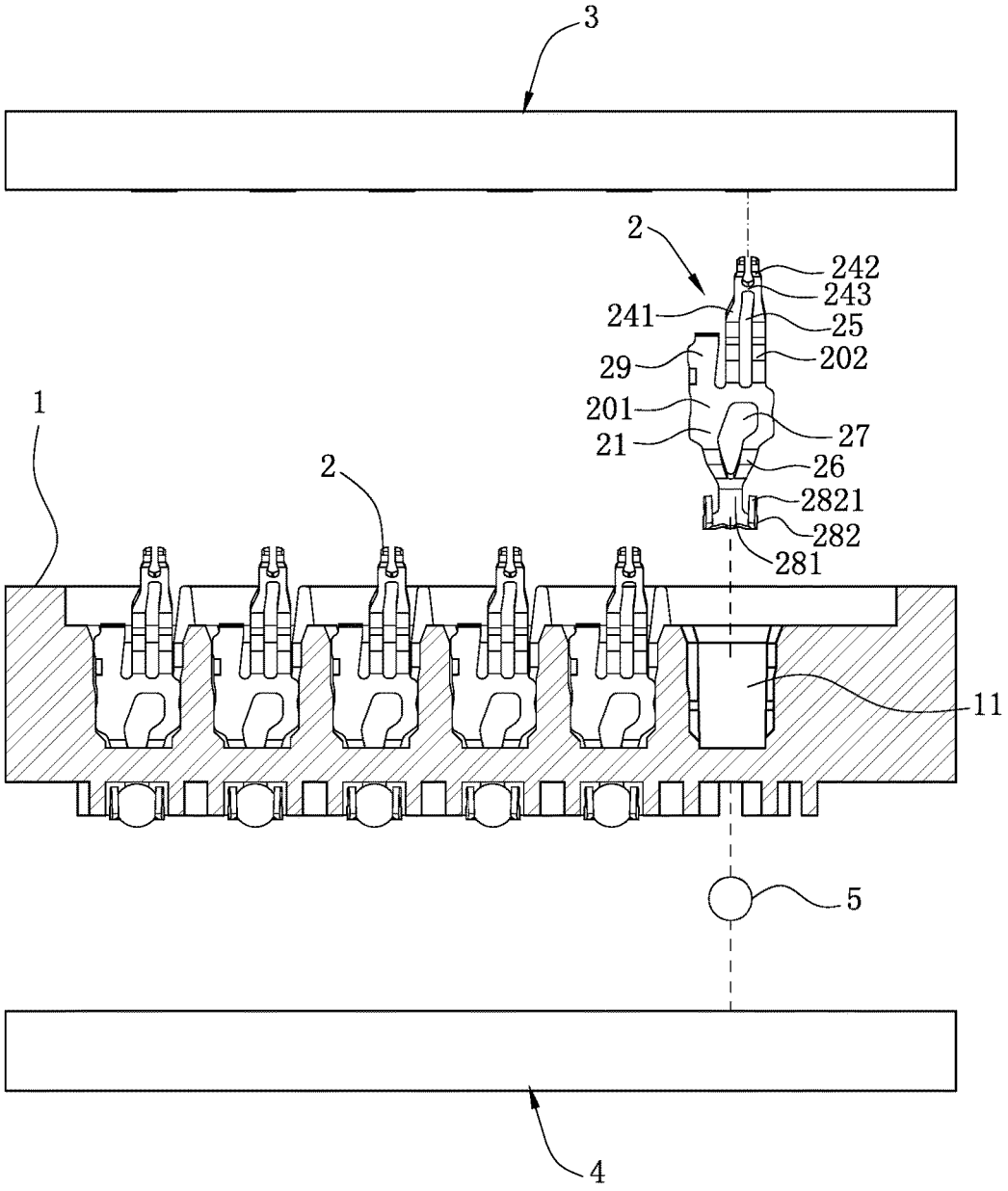
FIG. 17 is a schematic sectional view of the electrical connector according to the fifth embodiment of the present invention, before the electrical connector is soldered to a circuit board and before a chip module is installed.
Figure 18:
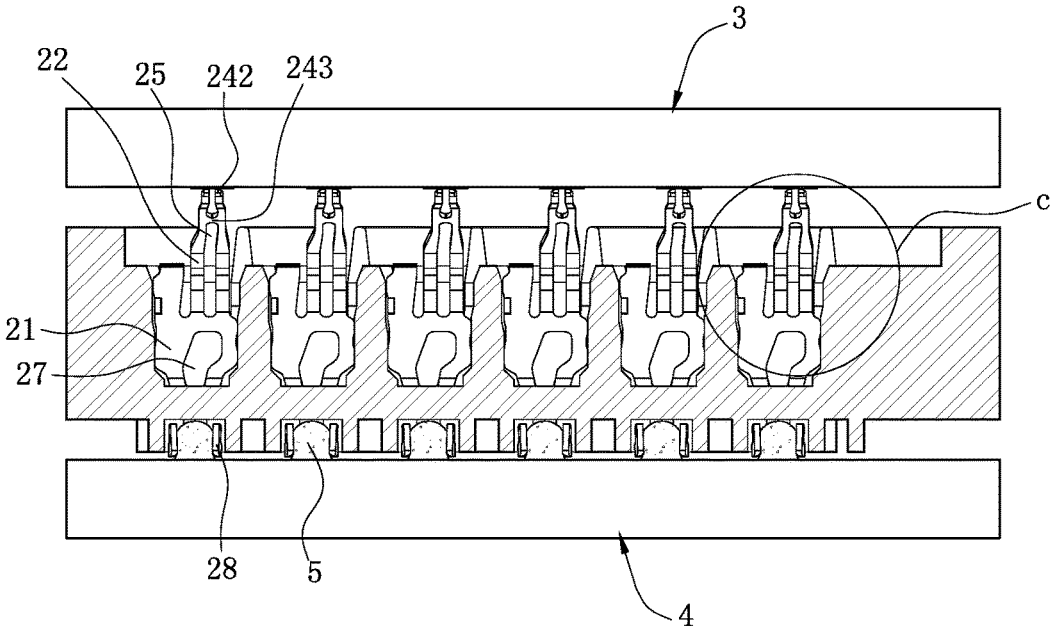
FIG. 18 is a plain sectional view of the electrical connector according to the fifth embodiment of the present invention, after the electrical connector is soldered to the circuit board and after a chip module is installed.
Figure 19:
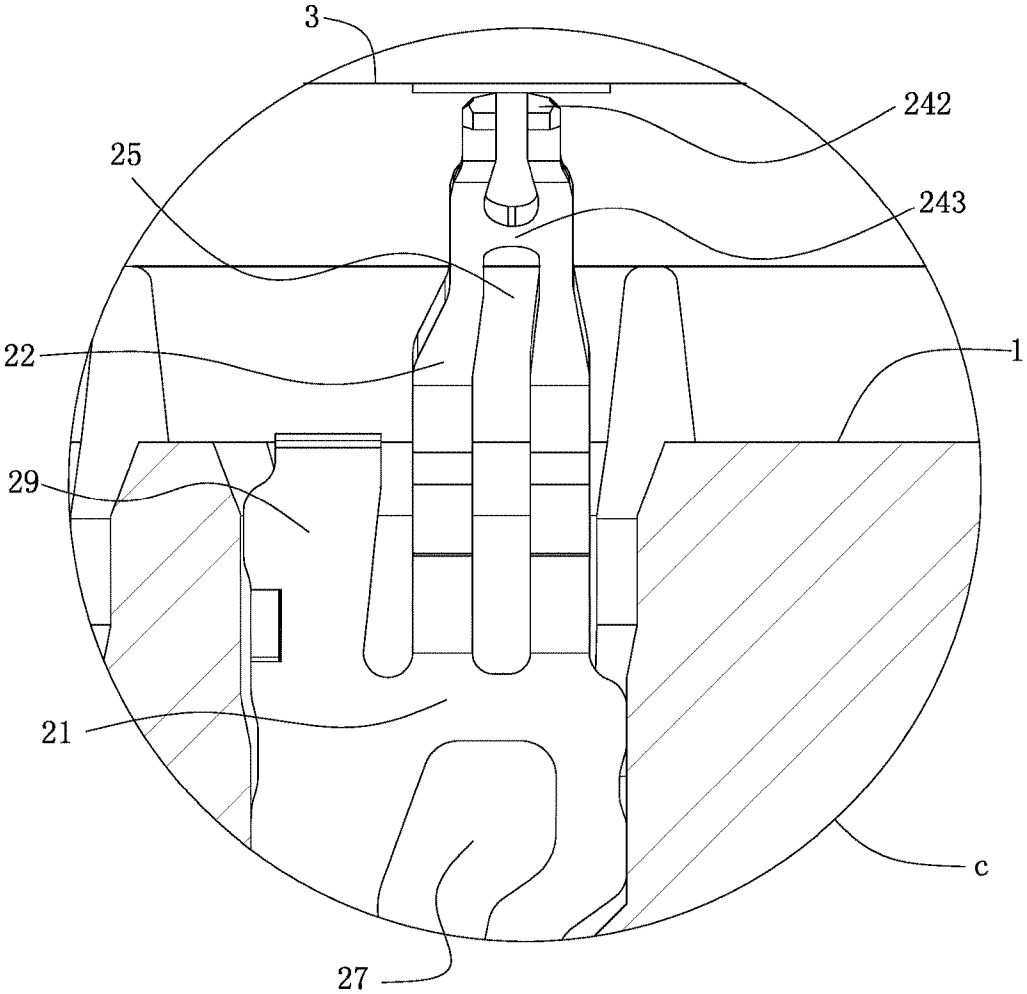
FIG. 19 is an enlarged view of a part C in FIG. 18.

FIG. 14 and FIG. 15 show an electrical connector 100 according to a fourth embodiment of the present invention. The fourth embodiment mainly differs from the third embodiment in that: a protruding portion 244 protrudes upward from the beam 243, and urges the chip module 3. The remaining structures and functions thereof are completely the same as those of the third embodiment, and details are not elaborated herein.

FIG. 16 to FIG. 19 show an electrical connector 100 according to a fifth embodiment of the present invention. The fifth embodiment mainly differs from the first embodiment in that: the beam 243 is disposed at a connecting location between the extending arm 241 and the contact portion 242, and the through-slot 25 runs through the free end of the contact portion 242, so that the contact portion 242 forms two free ends. The remaining structures and functions thereof are completely the same as those of the first embodiment, and details are not elaborated herein.

Figure 20:
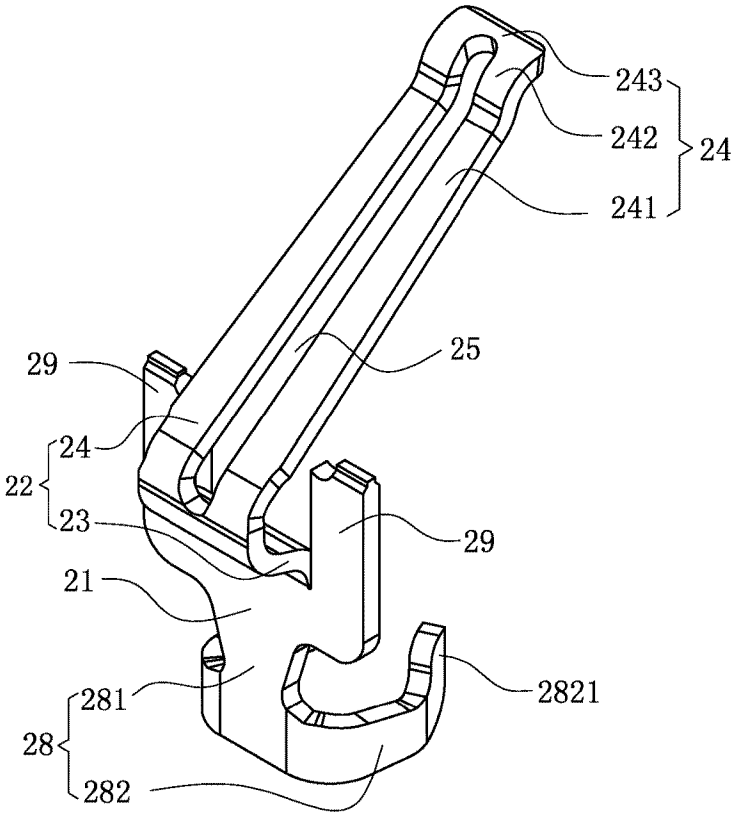
FIG. 20 is a perspective view of a terminal of a sixth embodiment of the electrical connector according to the present invention.
Figure 21:
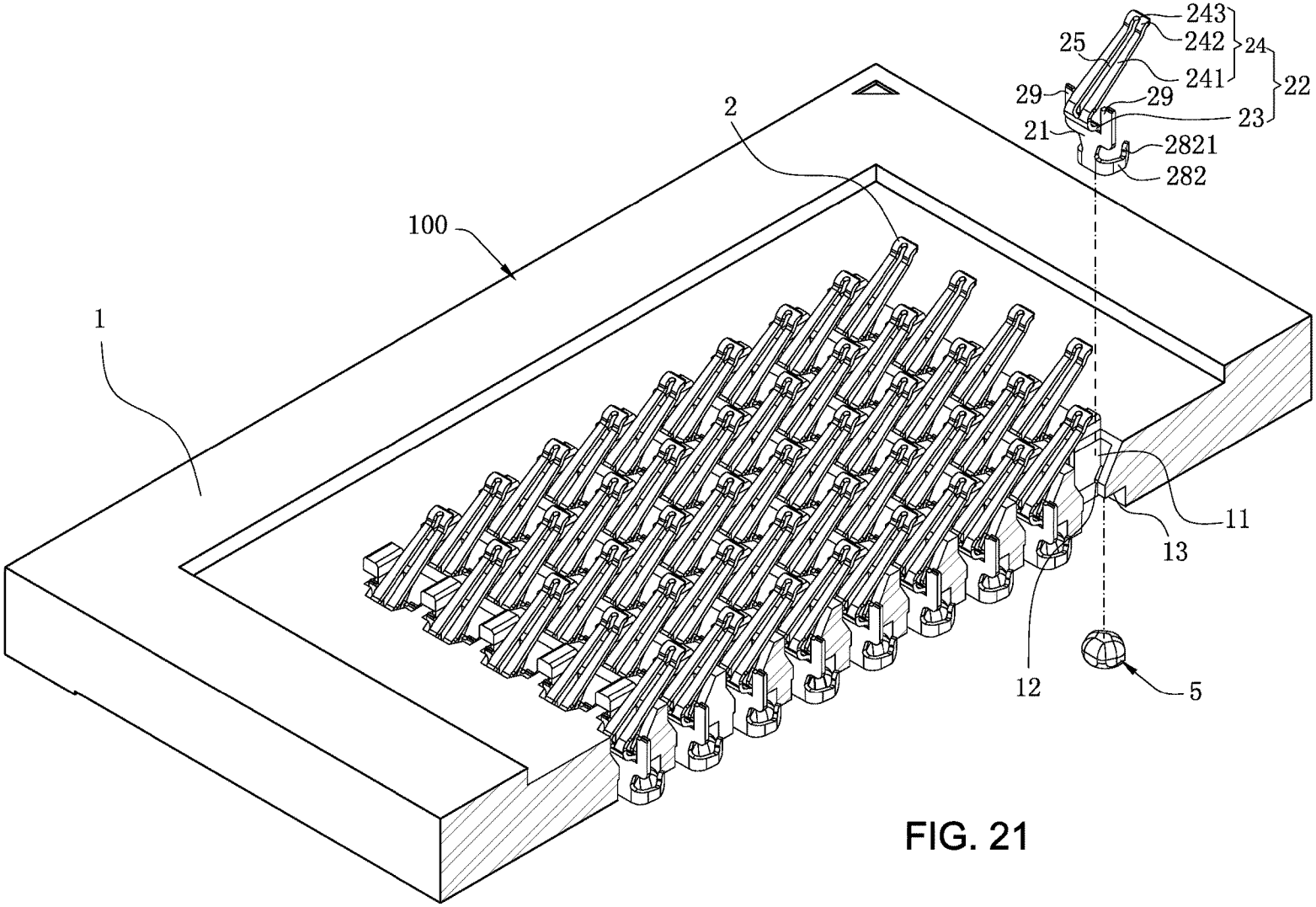
FIG. 21 is a schematic perspective sectional view of the electrical connector according to the sixth embodiment of the present invention.

FIG. 20 and FIG. 21 show an electrical connector 100 according to a sixth embodiment of the present invention. The fifth embodiment mainly differs from the first embodiment in that: in this embodiment, the through-slot 25 extends downward only to a bending location between the second arm 24 and the first arm 23. That is, the through-slot 25 does not run through the first arm 23, and the width of the through-slot 25 in the second arm 24 is a constant width. The through-hole 27 does not run through the base portion 21, and the strip connecting portion 29 extends upward from the base portion 21 at each of left and right sides of the elastic arm 22, so that each of the terminals 2 has two strip connecting portions 29. The remaining structures and functions thereof are completely the same as those of the first embodiment, and details are not elaborated herein.

Figure 22:
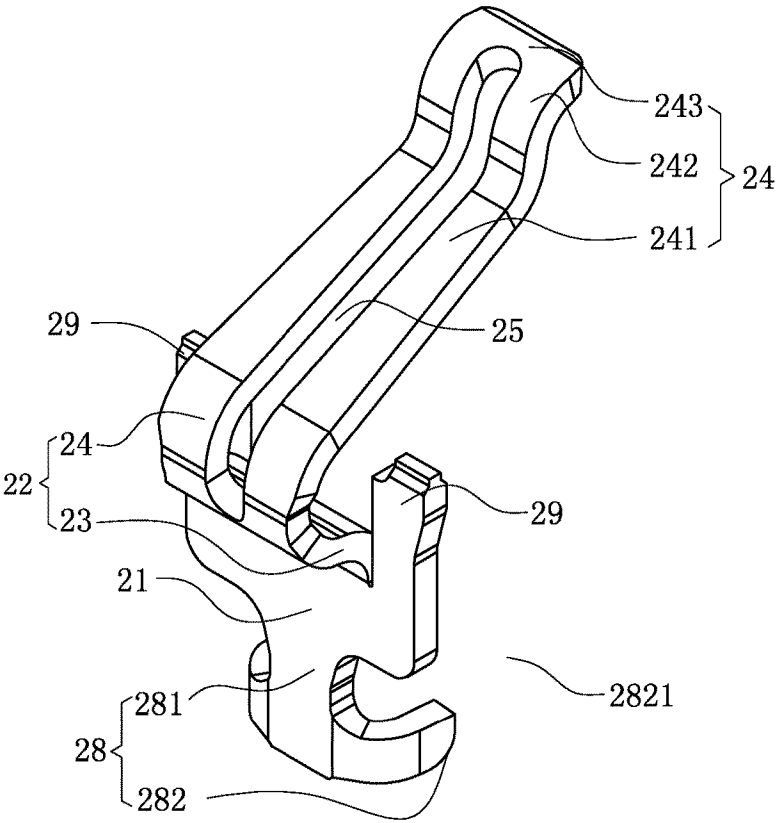
FIG. 22 is a perspective view of a terminal of an electrical connector according to a seventh embodiment of the present invention.

FIG. 22 shows an electrical connector 100 according to a seventh embodiment of the present invention. The seventh embodiment mainly differs from the sixth embodiment in that: the clamping portion 282 does not extend upward to form the stopping portion 2821. The remaining structures and functions thereof are completely the same as those of the sixth embodiment, and details are not elaborated herein.

To sum up, the electrical connector 100 according to certain embodiments of the present invention has the following beneficial effects.

(1) The through-slot 25 runs through the second arm 24 vertically, and the through-slot 25 at least extends to a bending location between the second arm 24 and the first arm 23, so as to reduce the self-inductance effect of the terminals 2 during signal transmission, avoid crosstalk between neighboring terminals 2, and improve the high-frequency signal transmission capability of the terminals 2. The second arm 24 forms two branches 202 at two opposite sides of the through-slot 25. Moreover, the second arm 24 has a beam 243, and the beam 243 connects the two branches 202, so as to prevent the two branches 202 from excessively moving toward a direction away from each other and causing undesired contact between the contact portion 242 and the chip module 3.

(2) The through-slot 25 runs through the elastic arm 22, and the through-hole 27 runs through the base portion 21 and the connecting portion 281, so that each of the terminals 2 form four conductive paths, including two conductive paths that are parallel to each other from top to bottom and are from two opposite sides of the through-slot 25 and the through-hole 27, and two crossed conductive paths that are from the left side of the through-slot 25 to the right side of the through-hole 27 and from the right side of the through-slot 25 to the left side of the through-hole 27. By means of these four conductive paths, the high-frequency signal transmission capability of the terminals 2 may be improved.

(3) An upper surface of the contact portion 242 slants downward to form a chamfering surface 2421, so that the contact area between the contact portion 242 and the pad of the chip module 3 is reduced, so as to reduce a risk of the contact portion 242 slipping off from the pad of the chip module 3.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector for electrically connecting with a chip module, comprising:
- an insulating body; and
- a plurality of terminals, respectively and correspondingly accommodated in the insulating body, each of the terminals having:
  - a base portion having a vertical plane;
  - a first arm, bending and extending upward from the base portion toward a direction away from the vertical plane;
  - a second arm, bending and extending reversely from the first arm and crossing the vertical plane, wherein the second arm is configured to abut the chip module; and
  - a through-slot, running through the second arm vertically, wherein the through-slot at least extends to a bending location between the second arm and the first arm, so that the second arm forms two branches at two opposite sides of the through-slot, and the second arm has a beam connecting the two branches,
  - wherein the second arm is provided with two protruding portions protruding upward symmetrically located at the two opposite sides of the through-slot, and the two protruding portions simultaneously abut a same pad of the chip module.

2. The electrical connector according to claim 1, wherein the terminals are formed by punching a metal plate, and a width of the through-slot is greater than a thickness of each of the terminals and less than a width of each of the branches.

3. The electrical connector according to claim 1, wherein the beam is disposed at an end of the second arm.

4. The electrical connector according to claim 1, wherein the second arm comprises an extending arm connected to the first arm and a contact portion bending and extending upward from the extending arm and configured to abut the chip module, the through-slot extends to the contact portion, and a width of the through-slot in the contact portion is less than a width of the through-slot in the extending arm.

5. The electrical connector according to claim 4, wherein the width of the through-slot in the contact portion is a constant width.

6. The electrical connector according to claim 1, wherein the through-slot extends to a connecting location between the first arm and the base portion.

7. The electrical connector according to claim 1, wherein the second arm has a contact portion configured to abut the chip module, and an upper surface of the contact portion slants downward to form a chamfering surface, so that a contact area between the contact portion and the chip module is reduced.

8. The electrical connector according to claim 1, wherein the base portion bends and extends downward to form a bending portion, the bending portion bends and extends to form a conducting portion configured to be conductively connected to a circuit board, and a through-hole runs through the base portion and the bending portion and does not run through the conducting portion.

9. An electrical connector for electrically connecting with a chip module, comprising:

an insulating body; and a plurality of terminals, respectively and correspondingly accommodated in the insulating body, each of the terminals having:

a base portion having a vertical plane;

a first arm, bending and extending upward from the base portion toward a direction away from the vertical plane;

a second arm, bending and extending reversely from the first arm and crossing the vertical plane, wherein the second arm is configured to abut the chip module; and a through-slot, running through the second arm vertically, wherein the through-slot at least extends to a bending location between the second arm and the first arm, so that the second arm forms two branches at two opposite sides of the through-slot, and the second arm has a beam connecting the two branches, wherein the second arm comprises an extending arm and a contact portion bending and extending from the extending arm, the beam is disposed at a connecting location between the extending arm and the contact portion, and the through-slot runs through a free end of the contact portion, so that the contact portion forms two free ends.

10. The electrical connector according to claim 9, wherein the terminals are formed by punching a metal plate, and a width of the through-slot is greater than a thickness of each of the terminals and less than a width of each of the branches.

11. The electrical connector according to claim 9, wherein the through-slot extends to a connecting location between the first arm and the base portion.

12. The electrical connector according to claim 9, wherein the second arm has a contact portion configured to abut the chip module, and an upper surface of the contact portion slants downward to form a chamfering surface, so that a contact area between the contact portion and the chip module is reduced.

13. The electrical connector according to claim 9, wherein the base portion bends and extends downward to form a bending portion, the bending portion bends and extends to form a conducting portion configured to be conductively connected to a circuit board, and a through-hole runs through the base portion and the bending portion and does not run through the conducting portion.

14. An electrical connector for electrically connecting a chip module to a circuit board, comprising:

an insulating body; and a plurality of terminals, respectively and correspondingly accommodated in the insulating body, each of the terminals having:

a base portion;

an elastic arm, bending and extending upward from one end of the base portion, and configured to abut the chip module;

a through-slot, running through the elastic arm, wherein in an extending direction of the elastic arm, a length of the through-slot is greater than sixty percent of a length of the elastic arm, the elastic arm forms two branches at two opposite sides of the through-slot, and the elastic arm has a beam connecting the two branches;

a bending portion, formed by bending and extending downward from an opposite end of the base portion;

a through-hole, extending from the base portion to the bending portion; and a conducting portion, formed by bending and extending from the bending portion, and configured to be conductively connected to the circuit board, wherein the through-hole does not run through the conducting portion, wherein the elastic arm has a contact portion configured to abut the chip module, and the through-slot runs through the contact portion to a free end of the contact portion, so that the contact portion forms two free ends and two contact areas simultaneously abutting a same pad of the chip module.

15. The electrical connector according to claim 14, wherein the through-slot extends downward to a connecting location between the elastic arm and the base portion.

16. The electrical connector according to claim 14, wherein the conducting portion comprises a connecting portion bending downward and extending from the bending portion, and two clamping portions bending and extending from two opposite sides of the connecting portion and jointly clamping a solder, the bending portion and the connecting portion are located at a same side of the base portion, and along a downward direction, a width of the bending portion is gradually reduced.

17. An electrical connector for electrically connecting a chip module to a circuit board, comprising:

an insulating body; and a plurality of terminals, respectively and correspondingly accommodated in the insulating body, each of the terminals having:

a base portion;

an elastic arm, bending and extending upward from one end of the base portion, and configured to abut the chip module;

a through-slot, running through the elastic arm, wherein in an extending direction of the elastic arm, a length of the through-slot is greater than sixty percent of a length of the elastic arm, the elastic arm forms two branches at two opposite sides of the through-slot, and the elastic arm has a beam connecting the two branches;

a bending portion, formed by bending and extending downward from an opposite end of the base portion;

a through-hole, extending from the base portion to the bending portion; and a conducting portion, formed by bending and extending from the bending portion, and configured to be conductively connected to the circuit board, wherein the through-hole does not run through the conducting portion, wherein the through-hole comprises a first through-hole disposed in the base portion, the first through-hole has a top edge and a side edge extending obliquely downward from the top edge, and the top edge and the side edge form an obtuse angle.

18. The electrical connector according to claim 17, wherein the through-hole further comprises a second through-hole disposed in the bending portion, the second through-hole is upward communicated with the first through-hole, and along a downward direction, a width of the second through-hole is gradually reduced.

19. The electrical connector according to claim 17, wherein the through-slot extends downward to a connecting location between the elastic arm and the base portion.

20. The electrical connector according to claim 17, wherein the conducting portion comprises a connecting portion bending downward and extending from the bending portion, and two clamping portions bending and extending from two opposite sides of the connecting portion and jointly clamping a solder, the bending portion and the connecting portion are located at a same side of the base portion, and along a downward direction, a width of the bending portion is gradually reduced.

* * * * *